United States Patent [19]

Ogawa et al.

[11] Patent Number: 5,016,578

[45] Date of Patent: May 21, 1991

[54] INTAKE MANIFOLD

[75] Inventors: Seiichi Ogawa; Minobu Sukimoto; Hitoshi Akiyoshi, all of Tochigi, Japan

[73] Assignee: Showa Aluminum Corporation, Sakai, Japan

[21] Appl. No.: 578,987

[22] Filed: Sep. 7, 1990

[30] Foreign Application Priority Data

Sep. 8, 1989 [JP] Japan ..... 1-10626[U]

[51] Int. Cl.[5] ..... F02M 35/10

[52] U.S. Cl. ..... 123/52 MC

[58] Field of Search ..... 123/52 M, 52 MC, 52 MB, 123/52MV, 52 MF

[56] References Cited

U.S. PATENT DOCUMENTS 2,845,912 8/1958 Bird ..... 123/52 MV
4,827,879 5/1989 Ohmi et al. ..... 123/52 MV
4,829,944 5/1989 Sukimoto et al. ..... 123/52 M
4,957,071 9/1990 Matsuo et al. ..... 123/52 MV

FOREIGN PATENT DOCUMENTS 0209623 10/1985 Japan ..... 123/52 M

*Primary Examiner*—David A. Okonsky
*Attorney, Agent, or Firm*—Armstrong, Nikaido, Marmelstein, Kubovcik & Murray

[57] ABSTRACT

The invention is drawn to an intake manifold for an internal combustion engine. The manifold is made of an aluminum plenum chamber having an air inlet and a plurality of air outlets with a plurality of wrought aluminum branch pipes extending from the respective plenum outlets. The branch pipes have an inner peripheral surface of circular cross section. At least one of the branch pipes is deformed at an intermediate portion along its length thereby forming a clearance area so that the branch pipe is free from contact with the adjacent branch pipe.

7 Claims, 6 Drawing Sheets

INTAKE MANIFOLD

BACKGROUND OF THE INVENTION

The present invention relates to an intake manifold, for example, for use with motor vehicle engines.

The term "aluminum" as used herein and in the claims includes pure aluminum, commercial pure aluminum containing small amounts of impurities and aluminum alloys. The term "wrought aluminum" as used herein and in the claims refers to an article of aluminum prepared by plastic working. The term "center line average height" is used herein and in the claims according to the definition of JIS B0601-1982.

Conventional intake manifolds, for example, for use with motor vehicle gasoline engines equipped with an electronically controlled fuel injection system comprise a plenum and branch pipes and are entirely prepared by casting. With the cast intake manifold, however, it is impossible to reduce the wall thickness thereof below a certain limit owing to the flow characteristics of molten metal to be cast, so that the manifold has the problem of inceased weight. Further since the surface of the casting is rough and has voids, the casting must be finished to a smooth surface at least internally to decrease the air resistance for an improved intake efficiency. Thus, the manifold has the problem of necessitating a cumbersome finishing procedure. Moreover, since it is impossible to finish the entire inner surface of the manifold in view of its configuration, the air resistance still remains to be reduced to achieve a higher intake efficiency.

To solve this problem, we have already proposed the intake manifold disclosed in U.S. Pat. No. 4,829,944.

For improved performance, some motor vehicle engines having intake ports and exhaust ports are recently so adapted that at least the intake ports provided are two in number for each cylinder, and these ports are each provided with a valve. In this case, each intake manifold has connected thereto one branch pipe of the intake manifold, so that the number of branch pipes required is twice the number of cylinders, hence a large number of branch pipes. Because the engine rooms of motor vehicles are limited in size, the intake manifold must be compacted, whereas the increase in the number of branch pipes imposes a limitation on compacting.

SUMMARY OF THE INVENTION

The main object of the present invention is to provide an intake manifold free of the foregoing problems.

The present invention provides an intake manifold which comprises an aluminum plenum chamber having an air inlet and a plurality of air outlets, and a plurality of branch pipes of wrought aluminum connected to the respective air outlets of the plenum chamber and each having an inner peripheral surface of circular cross section, at least one of the branch pipes being deformed at a lengthwise intermediate portion thereof, the outer peripheral surface of the deformed portion having a clearance area so as to be free from contact with another one of the branch pipes.

With the intake manifold of the present invention, at least one of the branch pipes is deformed at a lengthwise intermediate portion thereof, and the outer peripheral surface of the deformed portion has a clearance area so as to be free from contact with another branch pipe. Accordingly, the branch pipes can be arranged as desired without permitting interference therebetween. This makes it possible to arrange an increased number of branch pipes in a small space and therefore to provide a compacted manifold in conformity with the size of engine rooms of motor vehicles or the like.

In cross section, the inner periphery of the deformed portion having the clearance area on its outer periphery is in the form of a closed curve having no straight portion, and the deformed portion is approximately equal to the other portion in cross sectional area. The deformed portion therefore achieves the same intake efficiency as the circular portion, permitting the manifold to exhibit high performance despite the compacted construction. Further when the roughness of the inner surface of each branch pipe is up to 10 μm, preferably up to 5 μm, more preferably up to 1 μm, in terms of center line average height, the internal resistance to the flow of air is small to ensure an improved intake efficiency. Consequently, when mounted on an engine, the intake manifold permits the engine to exhibit improved performance in respect of output and torque.

The present invention will be described in greater detail with reference to the accompanying drawings.

DESCRIPTION OF THE PREFERRED EMBODIMENTS

Figure 1:
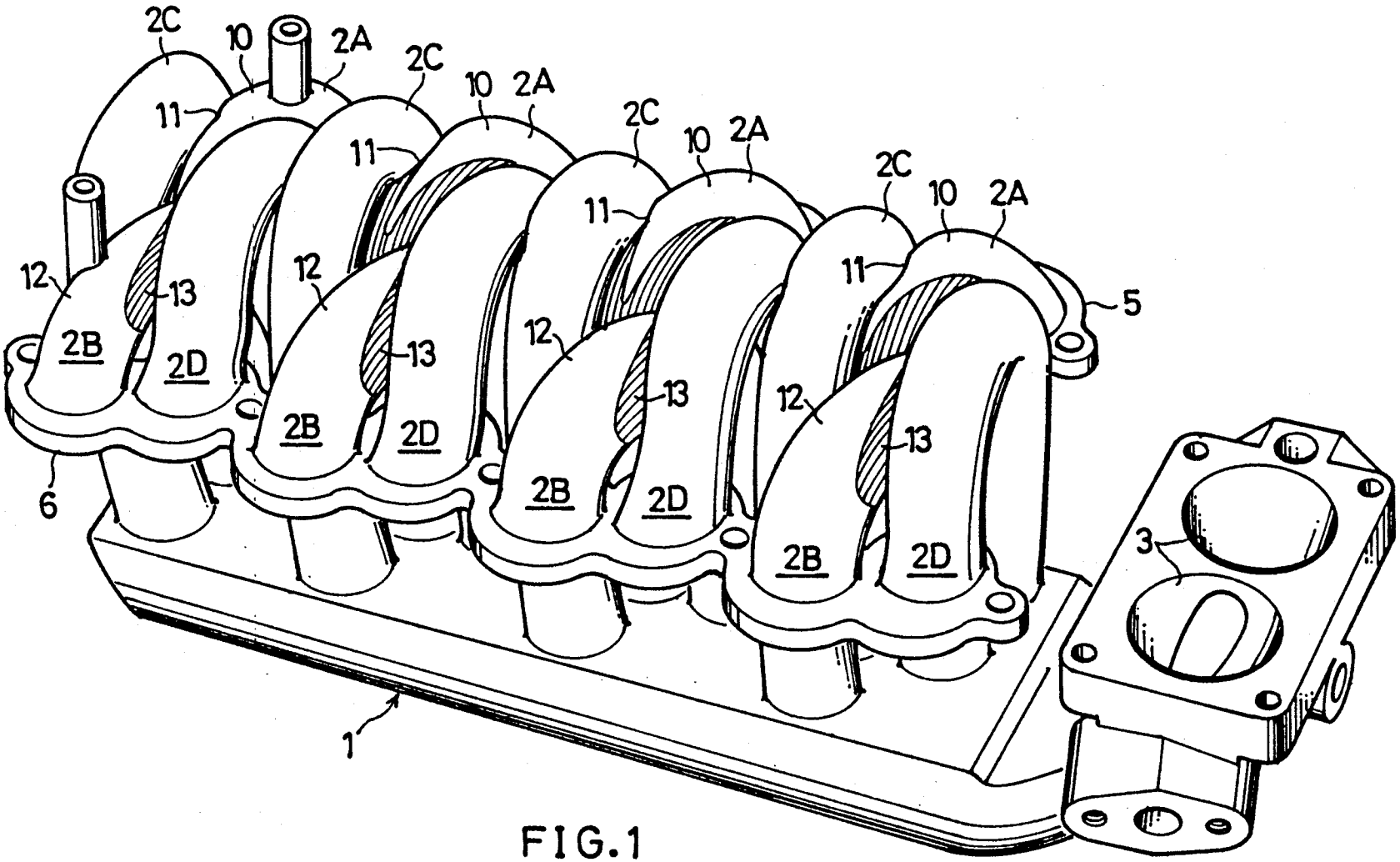
FIG. 1 is a perspective view showing an intake manifold embodying the invention.
Figure 2:
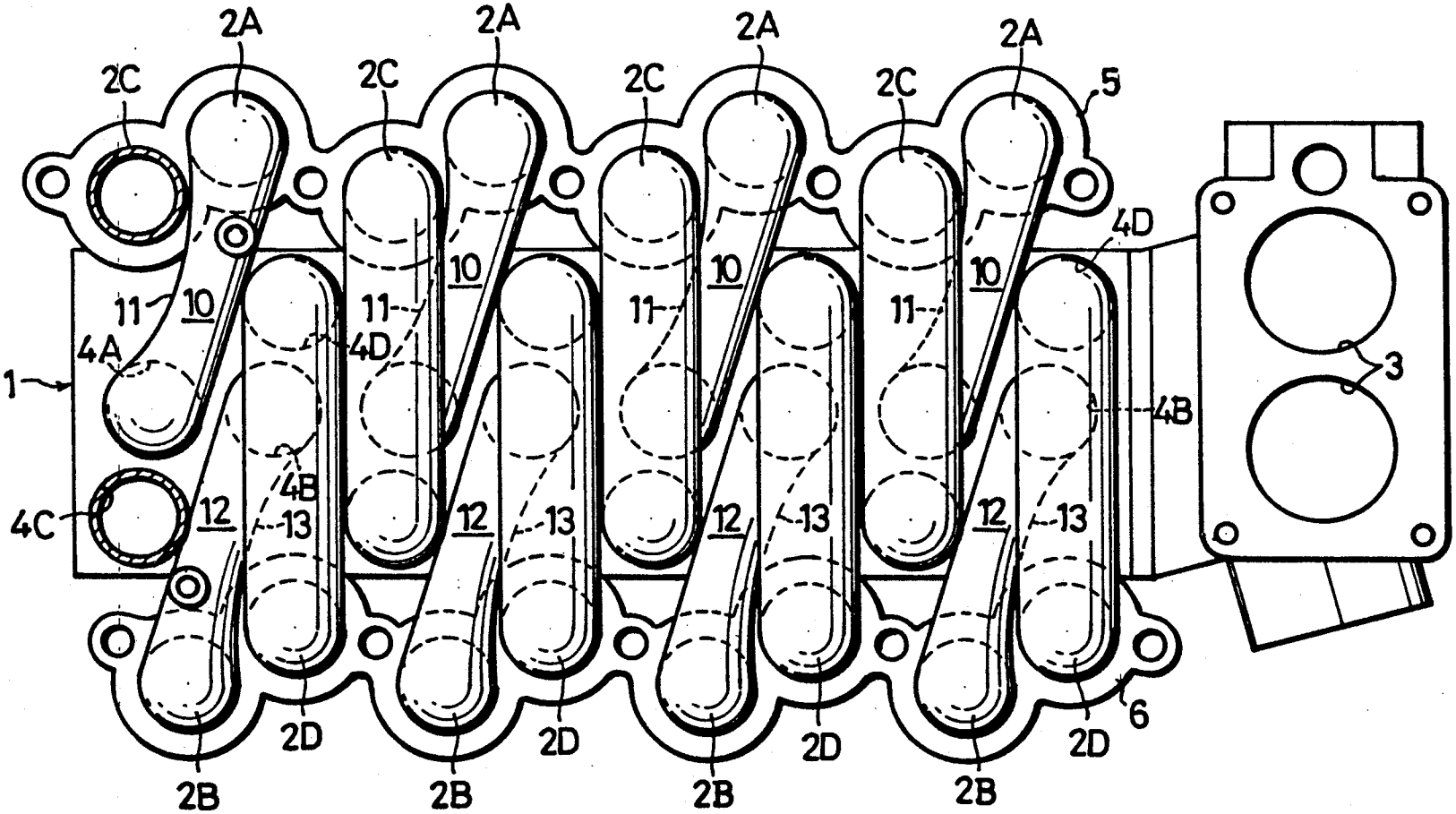
FIG. 2 is a plan view partly broken away and showing the manifold.
Figure 3:
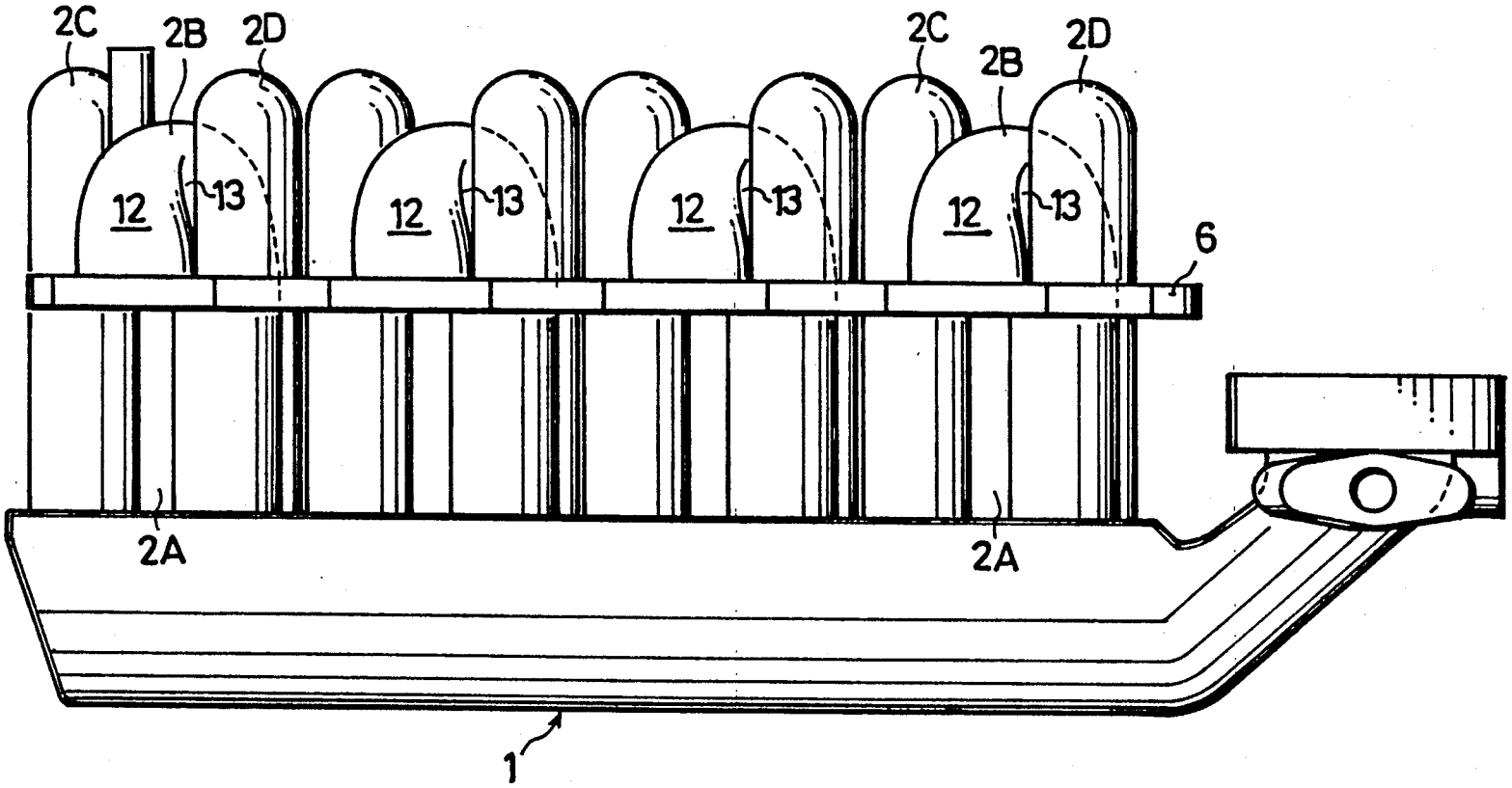
FIG. 3 is a side elevation of the same.
Figure 4:
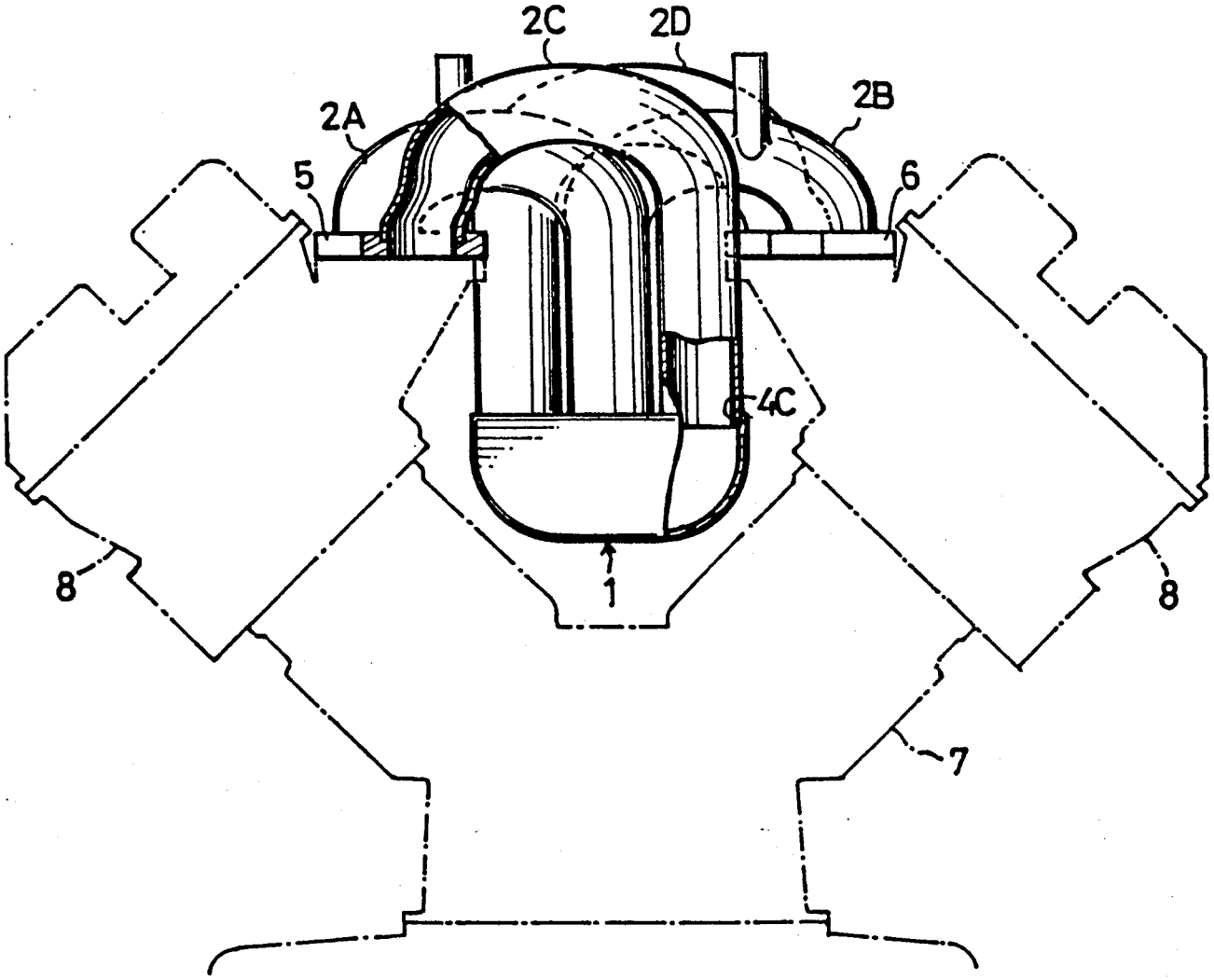
FIG. 4 is a rear view partly broken away and showing the same.

In the following description, the right-hand side of FIG. 2 will be referred to as "front," the left-hand side thereof as "rear," the upper side thereof as "left," and the lower side thereof as "right." The terms "upper" and "lower" are used as the embodiment is seen as illustrated in FIGS. 3 and 4.

FIGS. 1 to 4 show an intake manifold embodying the invention and adapted for use with motor vehicle engines having V-type eight cylinders each having two intake ports and two exhaust ports. With reference to these drawings, the intake manifold comprises a hollow plenum chamber 1 made of wrought aluminum or cast aluminum, and 16 branch pipes 2A, 2B, 2C and 2D of wrought aluminum connected to the plenum chamber 1.

The plenum chamber 1 has at its front end portion two air inlets 3. An air supply duct (not shown) extending from an air cleaner is connected to each air inlet 3. The upper wall of the plenum chamber 1 is formed in the widthwise central portion thereof with eight central air outlets 4A and 4B arranged in the front-to-rear direction at a predetermined spacing. Four right air outlets 4C are formed in the upper wall at the right side of the respective even-numbered four central air outlets 4A (first central air outlets) as the eight air outlets 4A, 4B are numbered from the front. Four left air outlets 4D are formed at the left side of the respective odd-numbered four central air outlets 4B (second central air outlets). Branch pipes 2A to 2D, generally inverted J-shaped when seen from the front, are connected to all the air outlets 4A to 4D, respectively. Each branch pipe 2A (first central branch pipe) connected to the first central air outlet 4A and each branch pipe 2C (right branch pipe) connected to the right air outlet 4C are connected at their forward ends to a flange 5 disposed at the left side of the plenum chamber 1 for connection to a cylinder head. Each branch pipe 2B (second central branch pipe) connected to the second central air outlet 4B and each branch pipe 2D (left branch pipe) connected to the left air outlet 4D are connected at their forward ends to a flange 6 disposed at the right side of the plenum chamber 1 for connection to a cylinder head. As seen in FIG. 4, the flanges 5, 6 are attached to the cylinder heads 8 of a V-type 8-cylindered engine 7. Each pair of adjacent first central branch pipe 2A and right branch pipe 2C, as well as each pair of adjacent second central branch pipe 2B and left branch pipe 2D, is connected to the intake ports of one of the cylinders of the engine 7.

Figures 6, 7, 8:
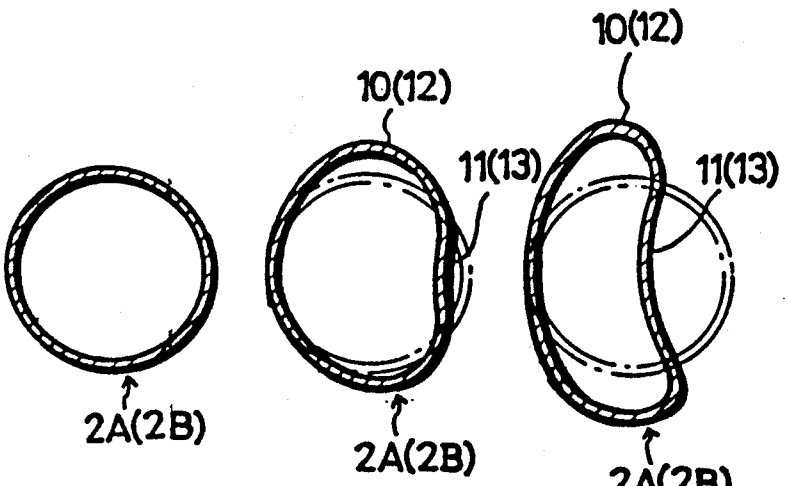
FIG. 6 is an enlarged view in section taken along the line VI—VI in FIG. 5.
FIG. 7 is an enlarged view in section taken along the line VII—VII in FIG. 5.
FIG. 8 is an enlarged view in section taken along the line VIII—VIII in FIG. 5.
Figure 9:
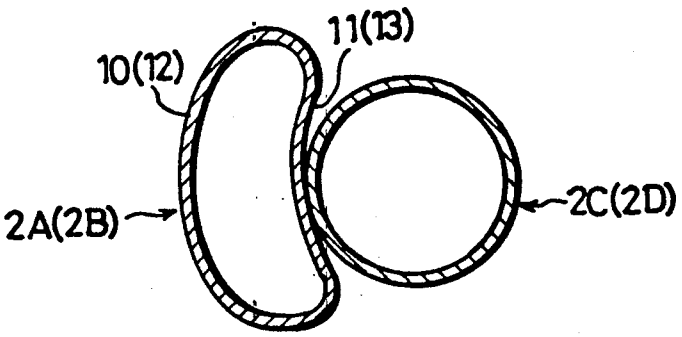
FIG. 9 is a sectional view showing the relation between the central branch pipe and a right or left branch pipe.
Figure 5:
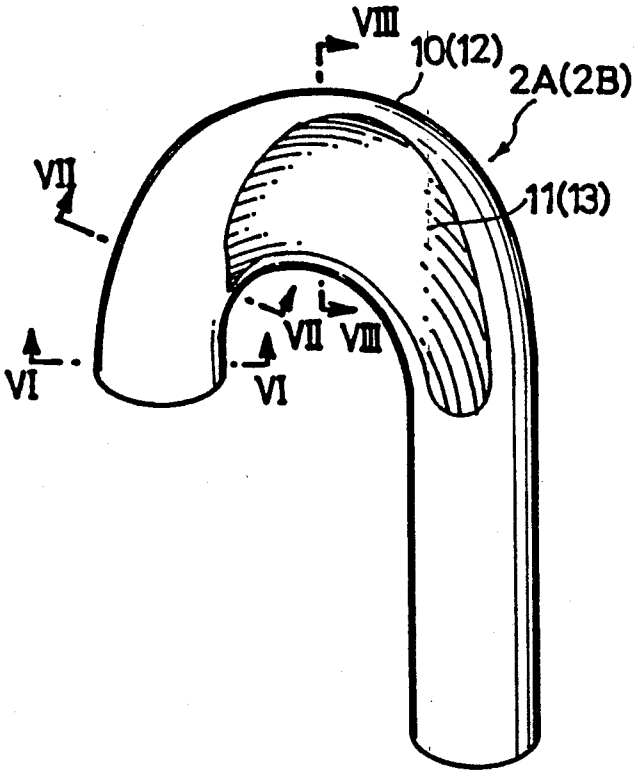
FIG. 5 is a perspective view showing a central branch pipe.

Each of the branch pipes 2A to 2D is prepared from a tubular material having a circular cross section and made, for example, of an aluminum extrudate. The roughness of the inner surface of the branch pipe is up to 10 μm, preferably up to 5 μm, more preferably up to 1 μm, in terms of center line average height. The first central branch pipe 2A extends from under the right branch pipe 2C obliquely leftwardly forward and is deformed as at 10 at a lengthwise intermediate portion thereof. The outer peripheral surface of the deformed portion 10 has a clearance area 11 so as to be free from contact with the right branch pipe 2C. The second central branch pipe 2B has the same shape as the first central branch pipe 2A, extends from under the left branch pipe 2D obliquely rightwardly rearward and is deformed as at 12 at a lengthwise intermediate portion thereof. The outer peripheral surface of the deformed portion 12 has a clearance area 13 so as to be free from contact with the left branch pipe 2D. FIG. 5 shows the central branch pipe 2A (2B). The pipe 2A (2B) has the deformed portion 10 (12) at a bend. In cross section, the inner peripheral surface of the central branch pipe 2A (2B) is circular over a specified length toward the flange 5 (6) and over a specified length toward the air outlet 4A (4B) (see FIG. 6). The cross sectional contour of the inner peripheral surface of the deformed portion 10 (12) is in the form of a closed curve having no straight portion. The clearance area 11 (13) gradually enlarges from opposite ends of the deformed portion 10 (12) toward the midpoint of length thereof (see FIGS. 7 and 8). The cross sectional area of the deformed portion 10 (12) is approximately equal to that of the circular portion. As shown in FIG. 9, the clearance area 11 (13) of the central branch pipe 2A (2B) serves to hold the pipe 2A (2B) out of contact with the right branch pipe 2C (the left branch pipe 2D). The clearance between the clearance area 11 (13) of the central branch pipe 2A (2B) and the right branch pipe 2C (the left branch pipe 2D) is at least 0.5 mm.

Figure 11:
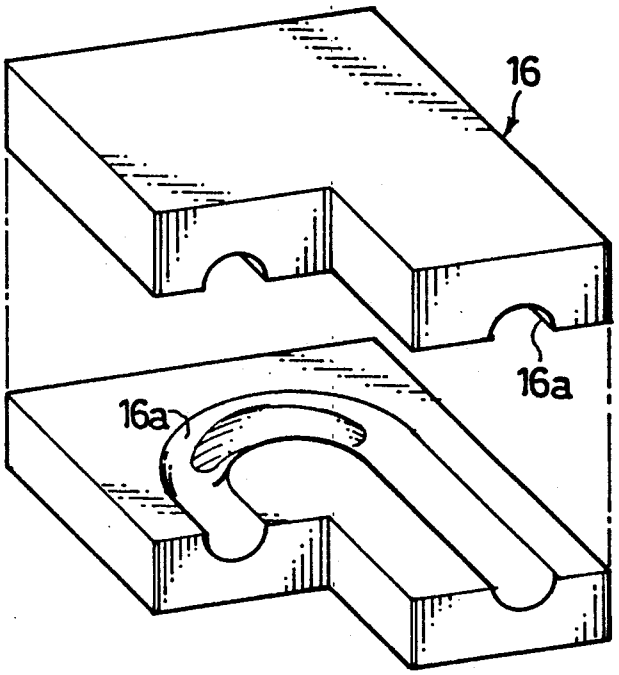
FIG. 11 is a perspective view showing a die for use in preparing the central branch pipe.
Figure 10A:
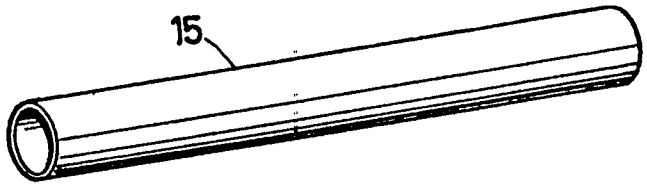
FIG. 10 is a perspective view showing stepwise a process for preparing the central branch pipe.
Figure 10B:
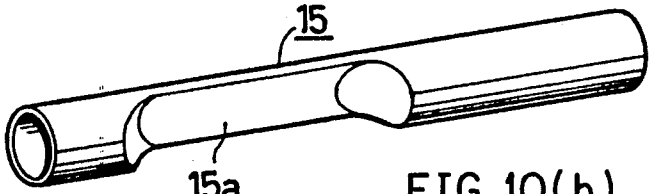
Figure 10C:
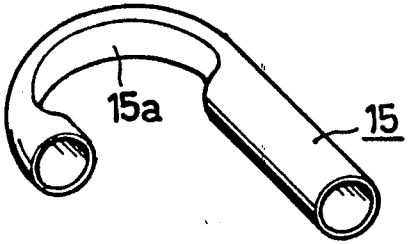
Figure 10D:
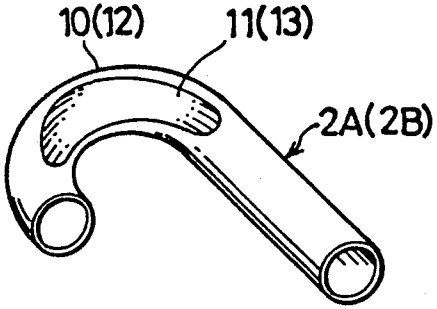

The central branch pipe 2A (2B) is prepared, for example, by the process shown in FIGS. 10 and 11. For the preparation of the pipe 2A (2B), a tubular material 15 is first prepared which is circular in cross section and made of an aluminum extrudate (see FIG. 10, (a)). A lengthwise intermediate portion of the material is collapsed to a flat form over a predetermined length (see FIG. 10, (b)). Next, the tubular material 15 is bent at the collapsed portion 15a to a J-form widthwise of the collapsed portion 15a (see FIG. 10, (c)). The J-shaped material 15 is thereafter placed into a die 16 which, as shown in FIG. 11, has cavities 16a shaped in conformity with the external configuration of the central branch pipe 2A (2B) having the deformed portion 10 (12). Subsequently, the material 15 is bulged by internally applying a liquid pressure or pneumatic pressure to the material 15. In this way, the central branch pipe 2A (2B) is formed as seen in FIG. 10, (d).

According to the embodiment described above, the right branch pipe 2C and the left branch pipe 2D are circular in cross section over the entire length thereof, and the central branch pipe 2A (2B) only is formed with the clearance portion 11 (13), whereas the central branch pipe 2A (2B) and the right branch pipe 2C (left branch pipe 2D) may each be formed with a clearance portion so as to be out of contact with each other.

What is claimed is:

1. An intake manifold comprising an aluminum plenum chamber having an air inlet and a plurality of air outlets, and a plurality of branch pipes of wrought aluminum connected to the respective air outlets of the plenum chamber and each having an inner peripheral surface of circular cross section, at least one of the branch pipes being deformed at a lengthwise intermediate portion thereof, the outer peripheral surface of the deformed portion having a clearance area so as to be free from contact with another one of the branch pipes.

2. An intake manifold as defined in claim 1 wherein the cross sectional contour of the inner peripheral surface of the deformed portion is in the form of a closed curve having no straight portion, and the cross sectional area of the deformed portion is approximately equal to the cross sectional area of the circular portion.

3. An intake manifold as defined in claim 1 wherein the surface roughness of the inner surface of each branch pipe is up to 10 μm in center line average height.

4. An intake manifold as defined in claim 1 wherein the surface roughness of the inner surface of each branch pipe is up to 5 μm in center line average height.

5. An intake manifold as defined in claim 1 wherein the surface roughness of the inner surface of each branch pipe is up to 1 μm in center line average height.

6. An intake manifold as defined in claim 1 wherein the clearance between the clearance area of the deformed portion and said another one of the branch pipes is at least 0.5 mm.

7. An intake manifold for an engine comprising an aluminum plenum chamber having an air inlet and air outlets equal in number to the number of the cylinders of the engine, and a plurality of branch pipes of wrought aluminum connected to the respective air outlets of the plenum chamber and each having an inner peripheral surface of circular cross section, at least one of the branch pipes being deformed at a lengthwise intermediate portion thereof, the outer peripheral surface of the deformed portion having a clearance area so as to be free from contact with another one of the branch pipes, the cross sectional contour of the inner peripheral surface of the deformed portion being in the form of a closed curve having no straight portion, the cross sectional area of the deformed portion being approximately equal to the cross sectional area of the circular portion.

* * * * *